US011115744B2

(12) United States Patent
Varanda et al.

(10) Patent No.: US 11,115,744 B2
(45) Date of Patent: Sep. 7, 2021

(54) AUDIO DEVICE WITH CONDUIT CONNECTOR

(71) Applicant: Knowles Electronics, LLC, Itasca, IL (US)

(72) Inventors: Brenno Varanda, Hoffman Estates, IL (US); Shehab Albahri, Hanover Park, IL (US)

(73) Assignee: Knowles Electronics, LLC, Itasca, IL (US)

( * ) Notice: Subject to any disclaimer, the term of this patent is extended or adjusted under 35 U.S.C. 154(b) by 155 days.

(21) Appl. No.: 16/371,484

(22) Filed: Apr. 1, 2019

(65) Prior Publication Data

US 2019/0306606 A1 Oct. 3, 2019

Related U.S. Application Data

(60) Provisional application No. 62/651,463, filed on Apr. 2, 2018.

(51) Int. Cl.
*H04R 1/10* (2006.01)

(52) U.S. Cl.
CPC ..... *H04R 1/1016* (2013.01); *H04R 1/1033* (2013.01); *H04R 1/1066* (2013.01)

(58) Field of Classification Search
CPC .. H04R 1/1016; H04R 1/1033; H04R 1/1066; H04R 2225/0216; H04R 2225/57; H04R 25/609; H04R 25/604; H04R 25/45
(Continued)

(56) References Cited

U.S. PATENT DOCUMENTS 4,461,529 A * 7/1984 Fariss ..... H01R 13/562 439/604
4,592,087 A 5/1986 Killion
(Continued)

FOREIGN PATENT DOCUMENTS

CN 101944883 A 1/2011
CN 204118900 1/2015
(Continued)

OTHER PUBLICATIONS

LPKF Laser & Electronics AG, "3-Dimensional Circuitry Laser Direct Structuring Technology (LPKF-LDS) for Moulded Interconnect Devices," Mar. 26, 2012.
(Continued)

*Primary Examiner* — Oyesola C Ojo
(74) *Attorney, Agent, or Firm* — Faegre Drinker Biddle & Reath LLP

(57) ABSTRACT

A hearing device includes a housing with a retention flange defining a retention space. A conduit is disposed about an electrical wire electrically coupled to a transducer and a ferrule is disposed about an end portion of the conduit and fixed along an axial dimension of the conduit, the ferrule having a portion disposable in the retention space. A bushing has a portion disposed at least partially about the portion of the ferrule disposable in the retention space, the bushing formed of a soft material relative to a hardness of the ferrule and the housing, wherein the bushing is located between the retention flange and the ferrule and the retention flange captures the conduit relative to the housing when the portion of the bushing is disposed in the retention space.

20 Claims, 8 Drawing Sheets

(58) Field of Classification Search
USPC ..... 381/62.2, 68, 322, 330; 439/382, 374, 439/680, 500
See application file for complete search history.

(56) References Cited

U.S. PATENT DOCUMENTS 4,689,819 A 8/1987 Killion
5,083,095 A 1/1992 Madaffari
5,193,116 A 3/1993 Mostardo
5,297,075 A 3/1994 Peters
5,337,011 A 8/1994 French
5,339,011 A 8/1994 Tamura
5,353,244 A 10/1994 Peters
5,446,413 A 8/1995 Loeppert et al.
5,559,892 A 9/1996 Boor
5,579,398 A 11/1996 Ewens
5,708,721 A 1/1998 Salvage et al.
5,861,779 A 1/1999 Loeppert
5,990,425 A 11/1999 Ashpes
6,028,502 A 2/2000 McSwiggen
6,068,506 A * 5/2000 Shen ..... H01R 13/562 439/447
6,307,944 B1 10/2001 Garratt
6,861,604 B2 3/2005 McSwiggen
6,972,386 B1 12/2005 McSwiggen
7,092,538 B2 8/2006 Potter
7,136,497 B2 11/2006 McSwiggen
7,162,039 B1 * 1/2007 Callahan ..... A61B 7/02 381/374
7,162,381 B2 1/2007 Boor
7,221,766 B2 5/2007 Boor
7,317,997 B2 1/2008 Boor
7,352,876 B2 4/2008 Boor
7,484,990 B1 * 2/2009 Lee ..... H01R 13/585 439/369
7,614,911 B2 * 11/2009 Hsieh ..... H01R 13/5845 174/135
7,688,987 B2 3/2010 Boor
7,706,559 B2 4/2010 Collins
8,073,153 B2 12/2011 Loeppert
8,123,547 B2 2/2012 Miller
8,604,880 B2 12/2013 Boor
8,638,965 B2 * 1/2014 Higgins ..... H01R 24/62 381/330
8,682,015 B2 3/2014 Miller
8,687,823 B2 4/2014 Loeppert
8,750,548 B2 6/2014 Christensen
8,798,304 B2 8/2014 Miller
8,890,615 B2 11/2014 Boor
2001/0036287 A1 11/2001 Beard
2002/0084855 A1 7/2002 Kwon
2002/0142795 A1 10/2002 Lmahori et al.
2003/0039374 A1 2/2003 Sudo
2003/0048911 A1 3/2003 Furst
2003/0128856 A1 6/2003 Boor
2003/0155980 A1 8/2003 Heima
2004/0179702 A1 9/2004 Boor
2004/0179703 A1 9/2004 Boor
2005/0018838 A1 * 1/2005 Meunier ..... H04R 1/1066 379/431
2005/0078841 A1 4/2005 Boor
2005/0152572 A1 7/2005 Suzuki
2005/0213787 A1 9/2005 Collins
2006/0067544 A1 3/2006 Moraghan
2007/0217628 A1 9/2007 Boor
2007/0223735 A1 9/2007 LoPresti
2007/0258616 A1 11/2007 Tsangaris et al.
2009/0136074 A1 * 5/2009 Chang ..... H04R 1/06 381/380
2009/0304216 A1 12/2009 Hansen
2010/0098284 A1 4/2010 Conklin
2010/0111340 A1 5/2010 Miller
2010/0128905 A1 5/2010 Warren
2011/0006845 A1 1/2011 Komer
2011/0261989 A1 10/2011 Xiao
2011/0311008 A1 12/2011 Nagum et al.
2011/0311088 A1 12/2011 Nagumo
2012/0018243 A1 * 1/2012 Miyazawa ..... H04R 1/06 181/126
2012/0045912 A1 2/2012 Dai
2012/0064845 A1 * 3/2012 Smith ..... H04R 1/105 455/90.2
2012/0329311 A1 * 12/2012 Duval ..... H01R 13/59 439/449
2013/0058506 A1 3/2013 Boor
2013/0189872 A1 * 7/2013 Siahaan ..... H01R 13/5845 439/447
2013/0259279 A1 10/2013 Hong
2014/0023216 A1 1/2014 Solum
2014/0097906 A1 4/2014 Jennings
2014/0112516 A1 4/2014 Jiles
2014/0112521 A1 4/2014 Wolfe
2015/0104035 A1 * 4/2015 Aoyagi ..... H04R 1/1033 381/74
2015/0110320 A1 4/2015 Song et al.
2015/0117675 A1 4/2015 Jennings
2016/0044428 A1 2/2016 Grossman
2017/0238104 A1 8/2017 Sanecki

FOREIGN PATENT DOCUMENTS

CN 204190936 U 3/2015
CN 204206433 U 3/2015
CN 204291355 U 4/2015
JP 2010154465 A 7/2010
KR 20-2009-0009617 U 9/2009
WO 2011/130739 A2 10/2011

OTHER PUBLICATIONS

Korean Intellectual Property Office, International Search Report and Written Opinion for PCT/US2013/063658 (related to above-captioned patent application), dated Jan. 23, 2014.
Korean Intellectual Property Office, International Search Report and Written Opinion for PCT/US2015/042665 (related to above-captioned patent application), dated Nov. 5, 2015.
European Patent Office; International Search Report and Written Opinion; International Application No. PCT/US2019/025302; dated Jul. 5, 2019.

* cited by examiner

AUDIO DEVICE WITH CONDUIT CONNECTOR

RELATED APPLICATIONS

This application claims priority to U.S. Provisional Patent Application Ser. No. 62/651,463 filed on Apr. 2, 2018, and entitled "Audio Device With Conduit Connector," the entire contents of which is hereby incorporated by reference.

TECHNICAL FIELD

This disclosure relates generally to audio devices and, more specifically, to conduit connecting mechanisms for audio devices and combinations thereof.

BACKGROUND

Audio devices having a conduit coupled thereto are known generally. For example, some hearing devices include a receiver-in-canal (RIC) portion worn at least partially in a user's ear canal and a behind-the-ear (BTE) portion worn behind the ear. The RIC portion typically includes a sound-producing electro-acoustic transducer disposed in a housing having a sound opening and an ear tip or other portion configured for insertion at least partially into the ear canal. The BTE portion typically includes a battery, microphone and an electrical circuit (e.g., amplifier) coupled to the RIC device by one or more wires disposed within in a relatively rigid conduit. In these and other hearing devices, the wire conduits are susceptible to shear, compressive, or tensile strain, particularly during insertion or removal of the RIC from the ear canal. The wire conduits also tend to transmit acoustic or mechanical vibration from the transducer toward the BTE portion and in some situations such vibration may be sensed by the microphone and cause undesirable feedback.

BRIEF DESCRIPTION OF THE DRAWINGS

The objects, features and advantages of the present disclosure will become more fully apparent to those of ordinary skill in the art upon careful consideration of the following Detailed Description and the appended claims in conjunction with the drawings described below.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. The terms and expressions used herein have the ordinary technical meaning as is accorded to such terms and expressions by persons skilled in the technical field as set forth above except where different specific meanings have otherwise been set forth herein.

DETAILED DESCRIPTION

The teachings of the present disclosure are generally applicable to hearing devices including a wire conduit coupled to a component of the hearing device. In some embodiments, the hearing device is a receiver-in-canal (RIC) portion for use in combination with a behind-the-ear (BTE) portion including a battery and an electrical circuit coupled to the RIC portion by wires disposed in a conduit that extends about the user's ear. The RIC portion typically includes a sound-producing electro-acoustic transducer disposed in a housing having an ear tip or other portion configured for insertion at least partially into a user's ear canal. In some embodiments the RIC portion forms an open-fit coupling with the user's ear wherein both ambient sound and amplified sound from the RIC portion enters the ear canal. In other embodiments the RIC portion forms a closed-fit coupling (i.e., a seal) with the user's ear. The teachings of the present disclosure are also applicable to other hearing devices that include a conduit coupled to one or more components of the hearing device.

Figure 1:
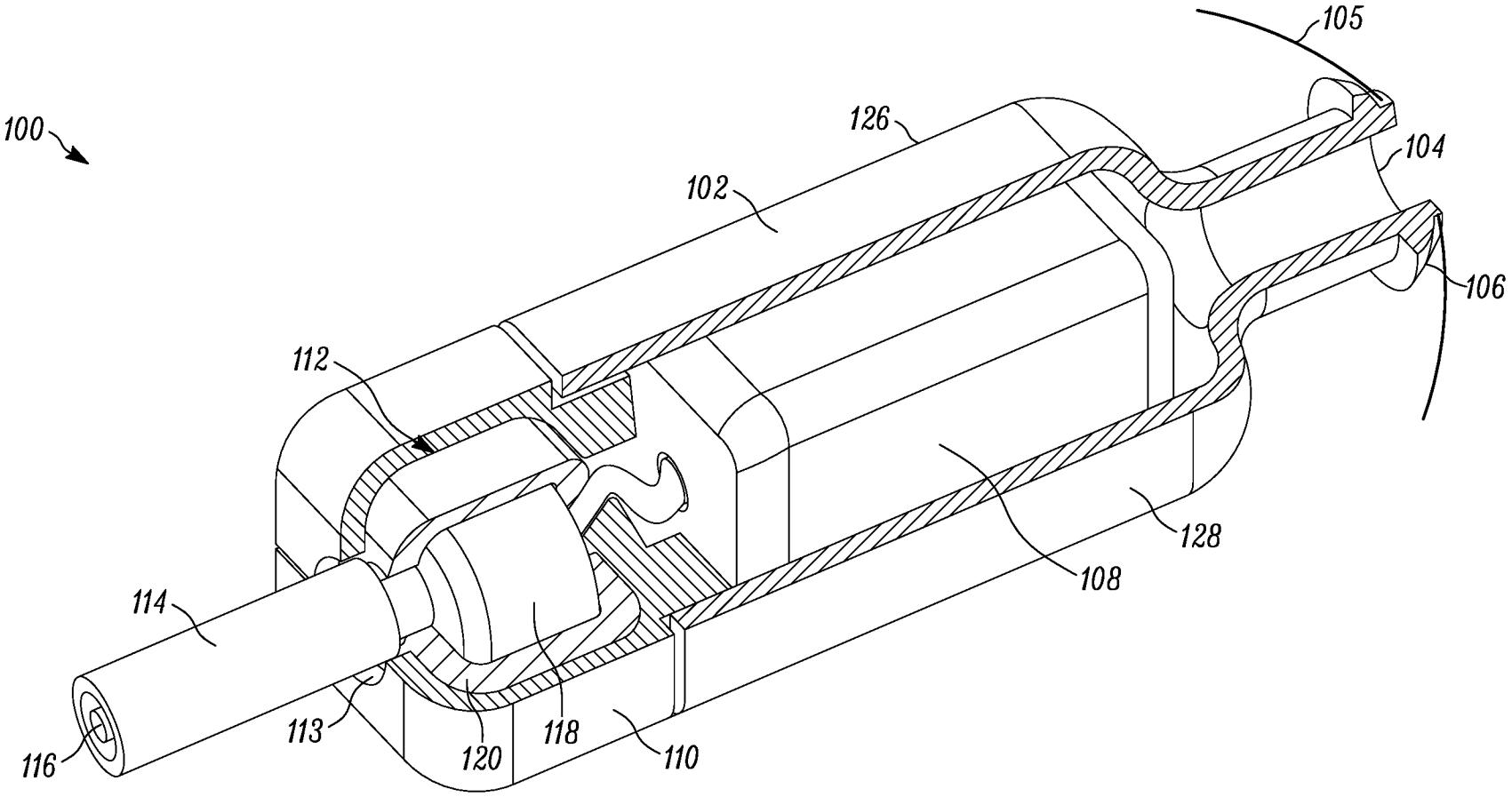
FIG. 1 is an illustration of a hearing device.
Figure 2:
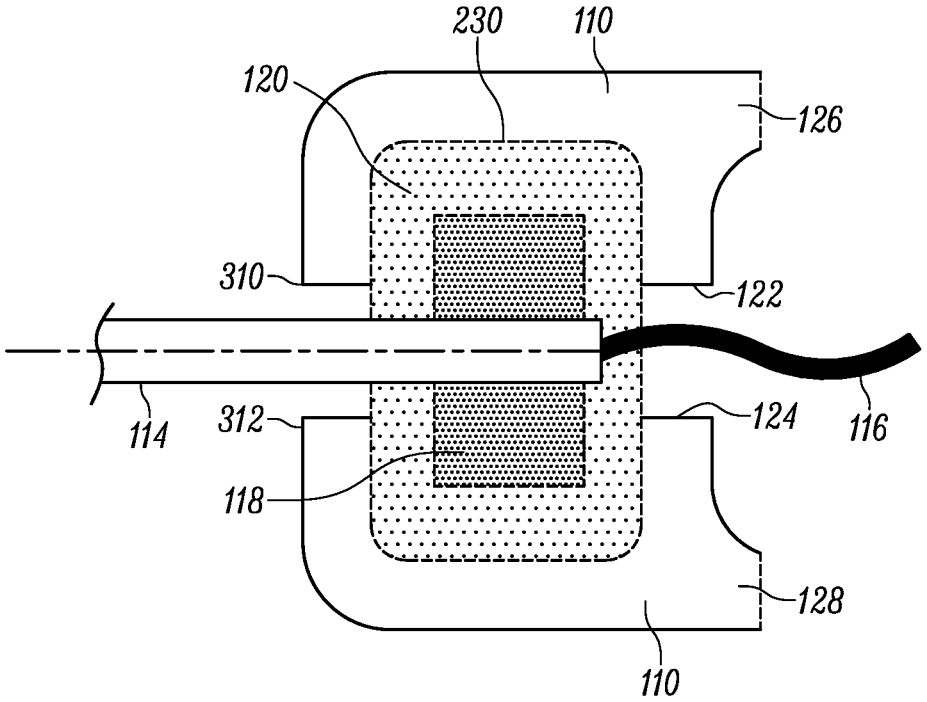
FIG. 2 is a cross-sectional view of a portion of a hearing device with a strain relief structure for a conduit.
Figure 3:
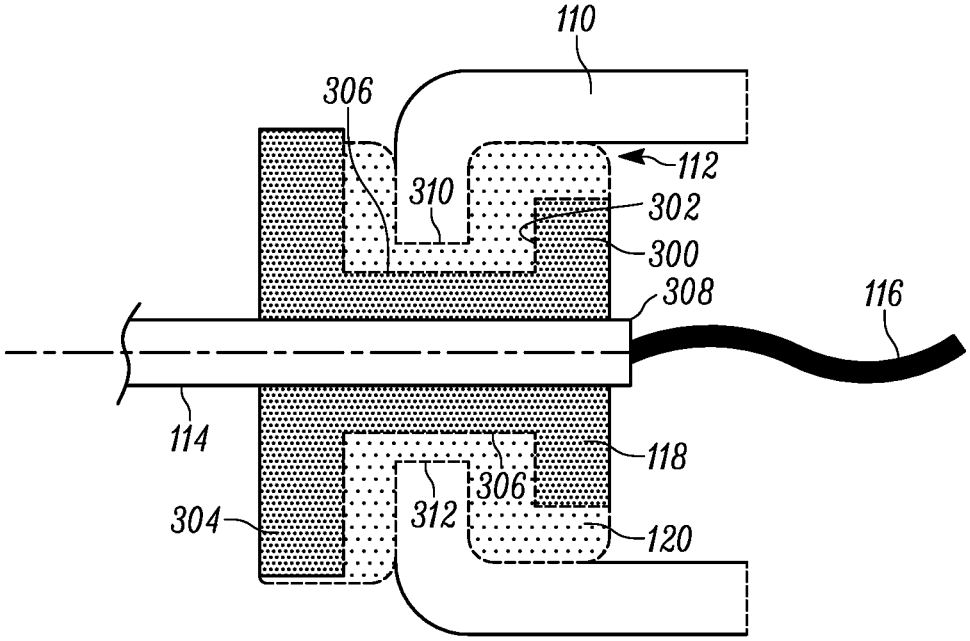
FIG. 3 is a cross-sectional view of a portion of a hearing device with a strain relief structure for a conduit.

Referring to FIGS. 1 and 2, a hearing device 100 includes a housing 102 having a sound opening 104 disposed in a portion 105 configured to contact the user's ear. In this example, the portion 105 is a dome or other ear tip configured for insertion at least partially into the user's ear canal. The ear tip may be a closed fit or open fit type or any other suitable type device as desired. The portion 105 is coupled to the nozzle 106 through any suitable attachment mechanism, or it is integrally molded with the housing as known in the art. A sound producing electro-acoustic transducer 108 is disposed in the housing 102. The transducer 108 in this example is a balanced armature receiver but can be any suitable acoustic transducer, such as, but not limited to, a dynamic speaker or any suitable combination thereof. The transducer 108 generates an acoustic signal in response to electrical excitation signal applied to the transducer. The acoustic signal is generated by the transducer 108 and emanates into the user's ear via the sound opening 104. The housing is a transducer housing that includes a cup and a cover and the retention flange extends from the transducer housing as shown in FIG. 1. The transducer can include a transducer housing disposed within the housing 102. Alternatively, the housing 102 of the hearing device and the housing of the transducer 108 can be integrated as a single housing. The retention flange 110 extends from the housing and may be integrated therewith or be a discrete part assembled with the housing.

Generally, the retention flange defines a retention space that houses part or all of a strain relief structure coupled to the conduit. In one embodiment, the retention flange is configured to circumferentially surround the strain relief structure. Such a circumferentially configured retention flange may have an annular sectional shape or a polygonal sectional shape or some other sectionals shape. However, other suitable shapes and configurations may be employed alternatively. For example, the retention structure may be configured as two or more fingers protruding from the housing wherein the fingers define a retention space and are expandable radially outwardly to receive and capture the strain relief structure.

The conduit is disposed about one or more electrical wires that provide a medium for electrical communication between the transducer and some other device, like a behind-the-ear unit or a host device. In some embodiments electrical power may also be provided by the wires as desired. In some embodiments, the electrical wire and tube are discrete parts forming a wire tube assembly. Alternatively, an extruded wire may be captured in a molded conduit to form an integrated assembly. In other embodiments, any other suitable electrical wiring and conduit structure may be employed.

Generally, the strain relief structure includes ferrule fixedly coupled to a conduit disposed about an electrical wire. In one embodiment, the ferrule is disposed about an end portion of the conduit and fixed along an axial dimension of the conduit. In other embodiments, the ferrule is not necessarily disposed along an axial dimension of the conduit. The strain relief structure also includes a bushing having a portion disposed at least partially about a portion of the ferrule. A material of the bushing relatively soft compared to a material of the ferrule. The bushing may be made of silicone, rubber, an elastomer curvative, foam, resin or any other suitable material including any suitable combination of the aforementioned materials. The housing and ferrule may be formed of metal, plastic mold injection or any other suitable material. At least a portion of the bushing disposed about a portion of the ferrule is disposed and retained in the retention space by the retention flange, wherein the bushing is located between the retention flange and the ferrule and wherein the conduit is fixed axially or rotationally relative to the housing. Various embodiments are described further herein.

In FIG. 1, a ferrule 118 is disposed about an end portion of the conduit 114 having a reduced diameter and the ferrule is fixed along an axial dimension of the conduit 114. In some embodiments, the ferrule is a blunt integrally formed on the conduit. In other embodiments, the ferrule is a metal or plastic sleeve disposed about and assembled with the conduit. In some embodiments, a sleeve is also fixed rotationally about the conduit, for example in applications where it is desirable to prevent rotation of the conduit relative to the housing. Alternatively, the ferrule may be molded over and about the conduit. However the ferrule may be embodied as any other suitable structure.

In FIGS. 1 and 2, a bushing 120 is disposed about the ferrule 118. The retention flange defines a retention space, in this example, a cavity 112 shaped to house and capture the bushing and ferrule, wherein the bushing is located between the ferrule and the retention flange. A conduit opening 113 in the retention flange accommodates passage of the conduit 114. In some embodiments, a ferrule is rotationally fixed within the bushing and the bushing is rotationally fixed within the retention space to prevent rotation of the conduit relative to the housing, examples of which are discussed herein. In other embodiments, it is not necessary to prevent rotation of the conduit, for example where the conduit is free to rotate about wires within the conduit. In embodiments where rotation is not a concern, it is not necessary to rotationally fix the conduit, ferrule, bushing and retention structure.

The bushing 120 is located between the retention flange 111 and the ferrule 118. The retention flange 110 captures the bushing 120. In this example, the ferrule 118 is a disk shaped member, however other shapes may be employed. In this example, the retention flange 110 also includes flange portions 122 and 124 that define a space through which the wire 116 passes through an opening to allow the wire to pass through to the transducer, as shown in FIG. 2. In this example, the retention flange 110 is configured in a clamshell design and has an annular shape. In FIG. 2, a first clamshell portion 126 and a second clamshell portion 128 combine to form the retention space. In this example, the ferrule and bushing are enclosed by the retention flange 110. In other examples, a portion of the flange and bushing extend outside an internal retention space defined by the retention flange, or the bushing extends partially outside the retention space defined by the retention flange, examples of which are discussed herein.

Referring to FIGS. 3, 6, 7 and 8, a two flanged ferrule design is depicted. In this example, a portion 300 of the ferrule 118 is disposable in the retention space 112. The ferrule 118 includes a flange portion 302 and another flange portion 304. The flange portions 302 and 304 are separated by a recess 306. The bushing 120 is at least partially disposed in the recess 306 of the ferrule 118. The bushing 120 is located between the retention flange 110 and the first and second flange portions 302 and 304. The retention flange captures the first and second flange portions 302 and 304 of the ferrule when the portion of the bushing is disposed in the retention space.

In this example, the end portion 308 of the conduit about which the ferrule 118 is disposed, is located at least partially in the retention space 112. An axial dimension of the ferrule 118 is aligned with the axial dimension of the conduit 114. In this example, flange portions 310 and 312 of the retention flange retain the bushing 120 through contact and are positioned in the recess 306 of the ferrule.

Figure 4:
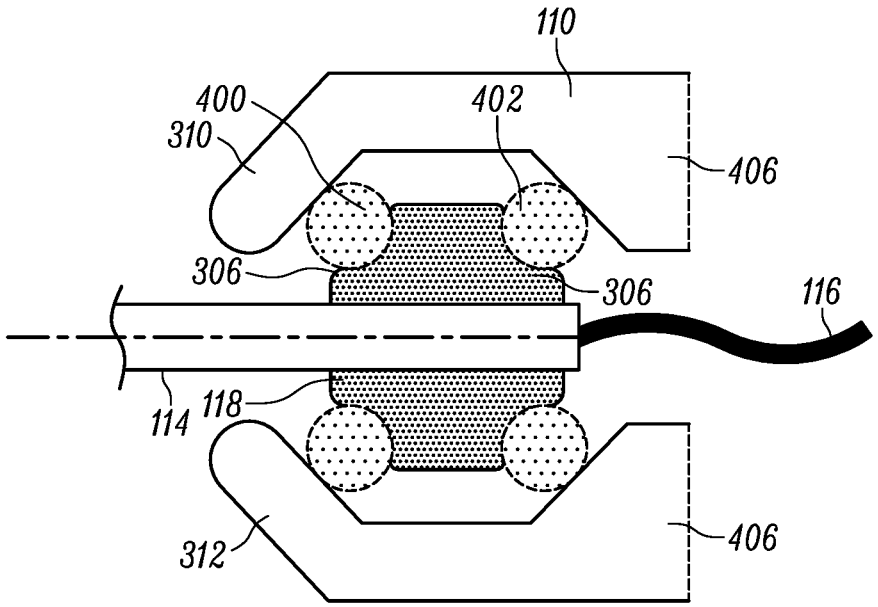
FIG. 4 is a cross-sectional view of a portion of a hearing device with a strain relief structure for a conduit.
Figure 5:
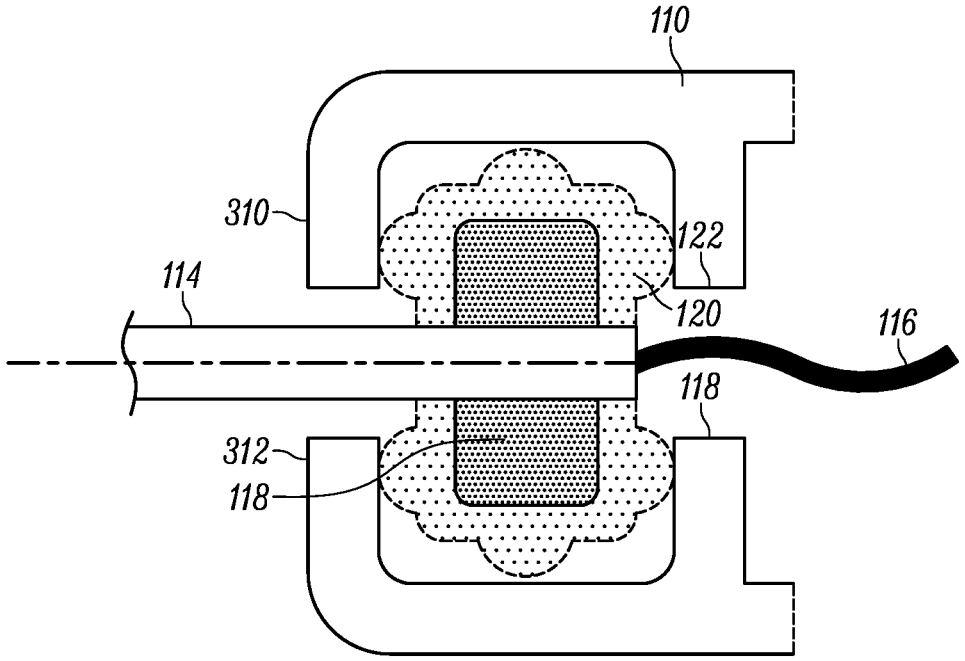
FIG. 5 is a cross-sectional view of a portion of a hearing device with a strain relief structure for a conduit.
Figure 6:
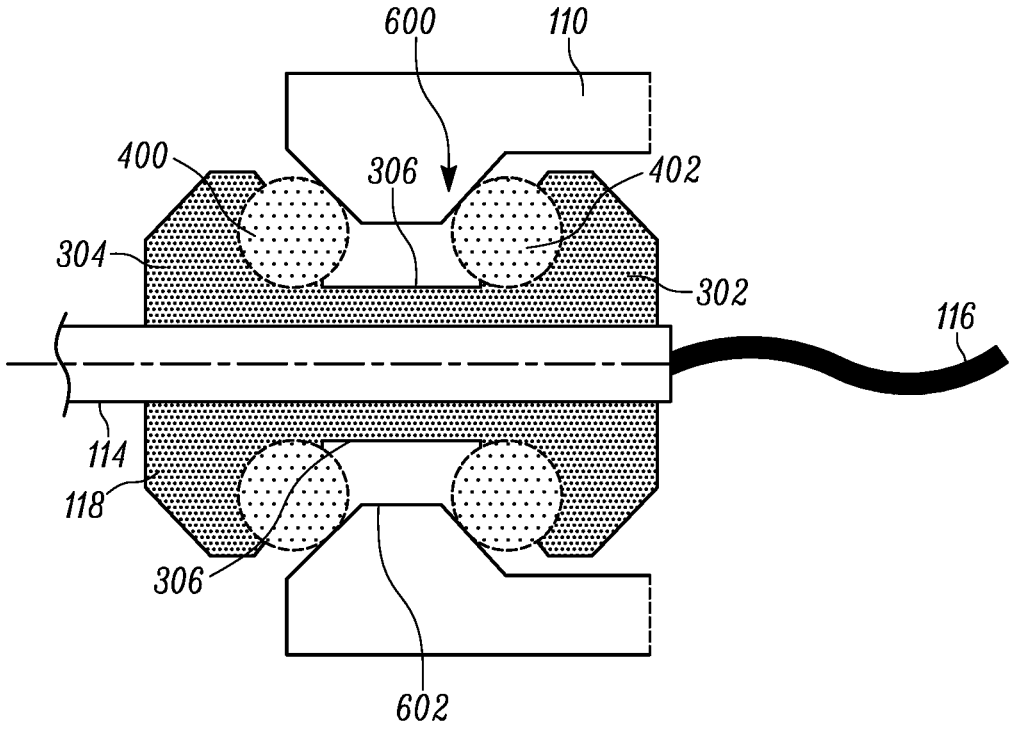
FIG. 6 is a cross-sectional view of a portion of a hearing device with a strain relief structure for a conduit.
Figure 7:
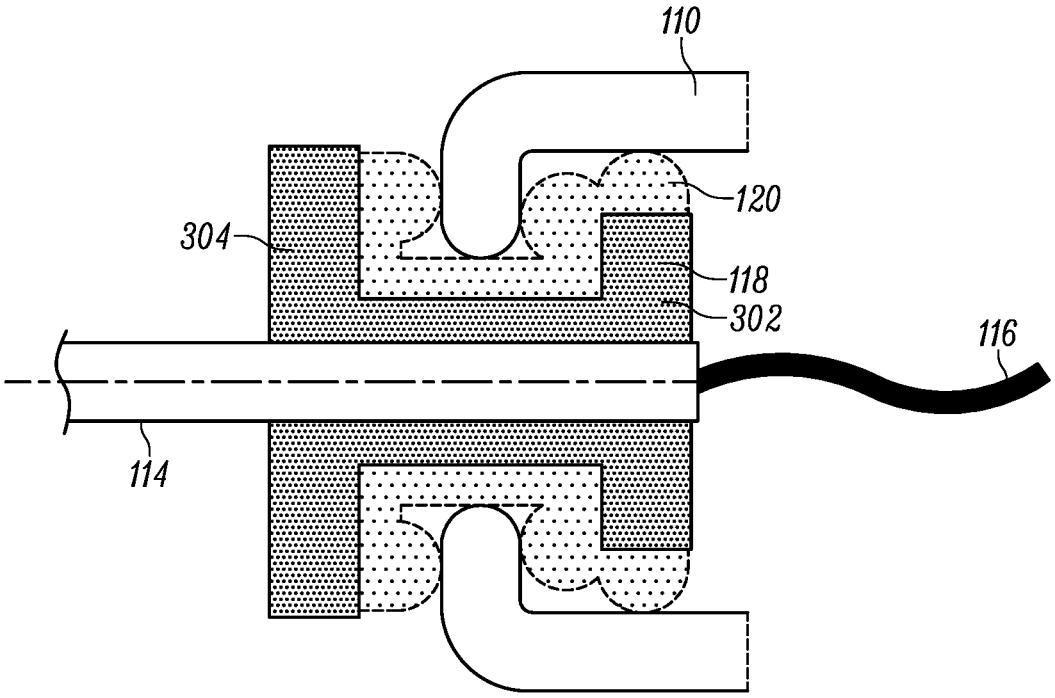
FIG. 7 is a cross-sectional view of a portion of a hearing device with a strain relief structure for a conduit.

Referring to FIGS. 4 and 6, a multiple O-ring bushing design is employed. As such, in some embodiments, the bushing includes first and second annular members 400 and 402 disposed about the ferrule 118 and seated in corresponding recesses 306 spaced apart from each other. The bushing also includes a second annular member 402 disposed about the ferrule 118 and seated in another recess 306. In FIG. 4, the flange portions 310 and 312 of the retention flange are angled. In other embodiments, the flanges portions 310 and 312 defining the retention space have a concave arcuate shape against which the O-rings are disposed. Thus configured, the annular member 400 is disposed between the first flange portion 310 and the ferrule and the annular member 402 is disposed between the flange portion 406 and the ferrule.

Figure 8:
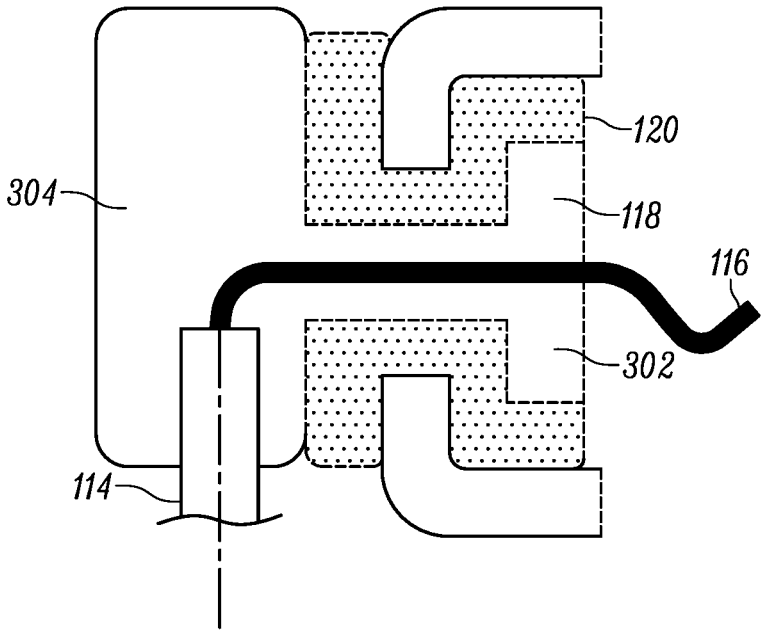
FIG. 8 is a cross-sectional view of a portion of a hearing device with a strain relief structure for a conduit.
Figure 9:
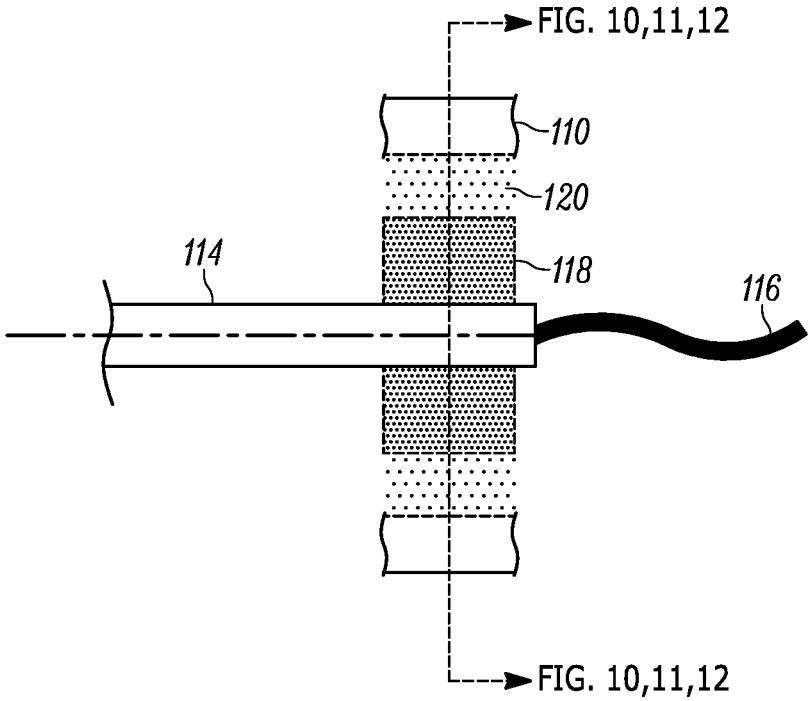
FIG. 9 is an illustration of a cross-sectional view illustrating a non-circular shape of a housing and strain relief mechanism.
Figure 10:
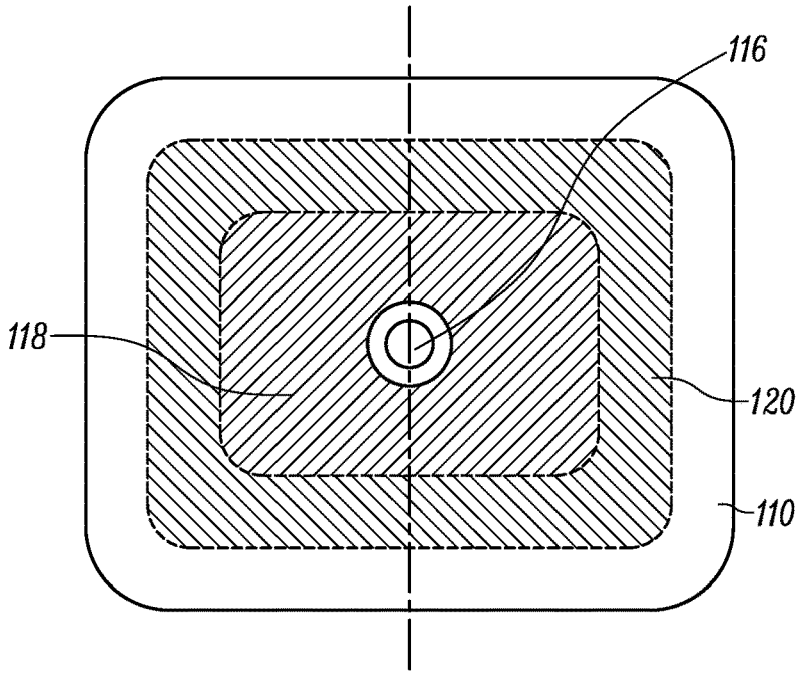
FIG. 10 is a cross-sectional view taken along lines a-a of FIG. 9.
Figure 11:
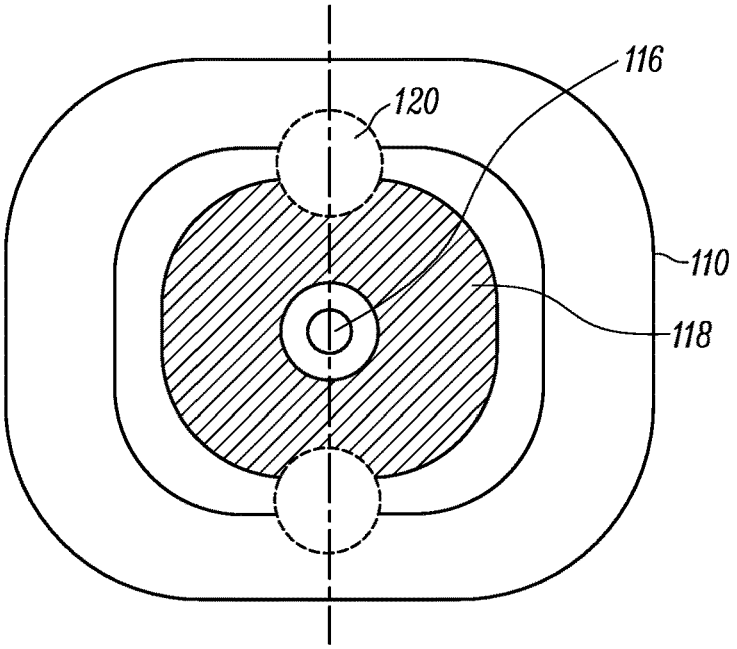
FIG. 11 illustrates a cross-sectional view of a portion of a hearing device illustrating a strain relief structure.

As illustrated in FIGS. 2-7, 13 and 15, an end portion of the conduit about which the ferrule is disposed, is located at least partially in the retention space and an axial dimension of the ferrule is aligned with the axial dimension of the conduit. In contrast, FIG. 8 illustrates an example where the end portion of the conduit about which the ferrule is disposed does not reside in the retention space. Instead, the conduit is located in a portion of the ferrule that is outside the retention space and in this example, is at a perpendicular orientation with respect to the axial dimension of the ferrule. However, any suitable angle may be employed. As such, various embodiments illustrate that the ferrule and bushing are positioned at least partially in the retention space and some of the embodiments illustrate that the entire ferrule and bushing are positioned in the retention space.

In one embodiment, the retention flange includes a generally convex surface, which may embodied as a continuous arcuate surface or a faceted surface. In FIG. 6, the retention flange 110 includes a multi-faceted surface generally shown as 600 and 602 wherein the first annular member 400 is disposed between the flange portion 304 of the ferrule and a facet 600 of the retention flange and the second annular member 402 is disposed between the flange portion 302 of the ferrule 118 and the facet 602 of the retention flange 110. Alternatively, the surfaces 600 and 602 of the retention flange could have a continuous convex curvature against which the annular members 400 and 402 are disposed.

In FIG. 2, the retention flange 110 includes a first flange portion 310 and another flange portion 122 separated by a recess 230. The bushing 120 is disposed at least partially in the recess of the retention flange. The bushing is located between the ferrule 118 and the flange portions 310 and 122. The bushing and ferrule are captured in the retention space between the flange portions 310 and 122. In this example, the retention flange 110 has flange portions 312 and 124 on one portion of the housing and flange portions 310 and 122 on another, mating portion of the housing 110.

In some embodiments, the strain relief structure and/or retention flange is configured to prevent rotation of the strain relief structure and/or conduit relative to the housing. For example, the ferrule may be glued to the bushing, the bushing may be glued to the retention structure, and the conduit may be fastened to the ferrule in a way that prevents rotation as suggested herein. In other embodiments, the structure of the bushing and/or ferrule and/or retention flange may be configured to prevent the strain relief structure from rotating relative to the housing. In other embodiments, a key or some other protruding structure may be used to prevent relative rotation of the strain relief structure and/or conduit relative to the housing. Some examples are discussed further herein.

Figure 12:
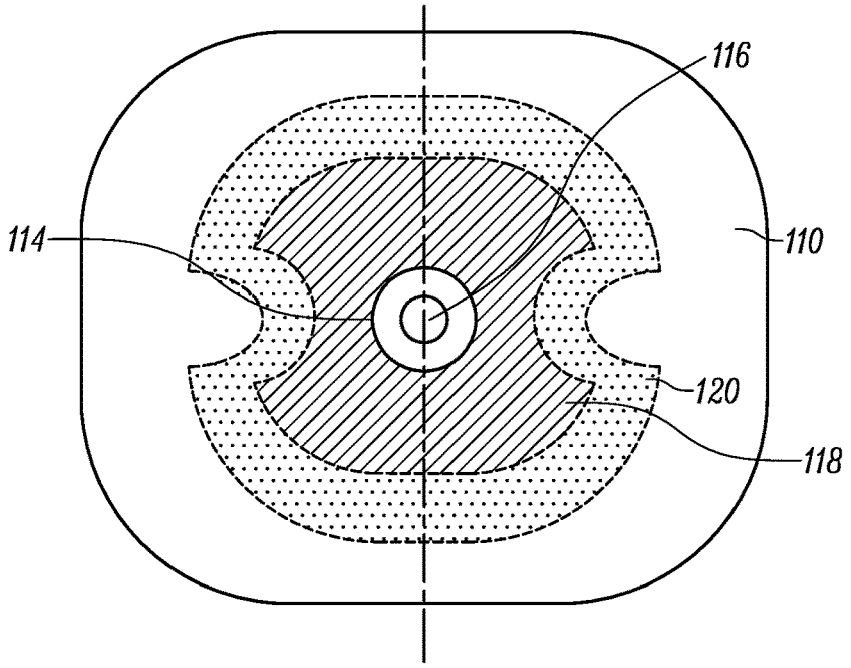
FIG. 12 is a cross-sectional view of a portion of a hearing device with a strain relief structure for a conduit.

Referring to FIGS. 9-12, the strain relief structure includes a non-circular sectional shape when the ferrule is viewed along the axial dimension of the conduit. The retention flange and bushing have non-circular complementary shapes that limit relative rotation. The ferrule can be securely fastened to the bushing or the ferrule can have a non-circular shape to prevent rotation of the ferrule relative to the bushing. As suggested, the conduit may be rotationally fixed relative to the conduit. For example, FIG. 12 illustrates a notch design between the retention flange and the ferrule.

Figure 13:
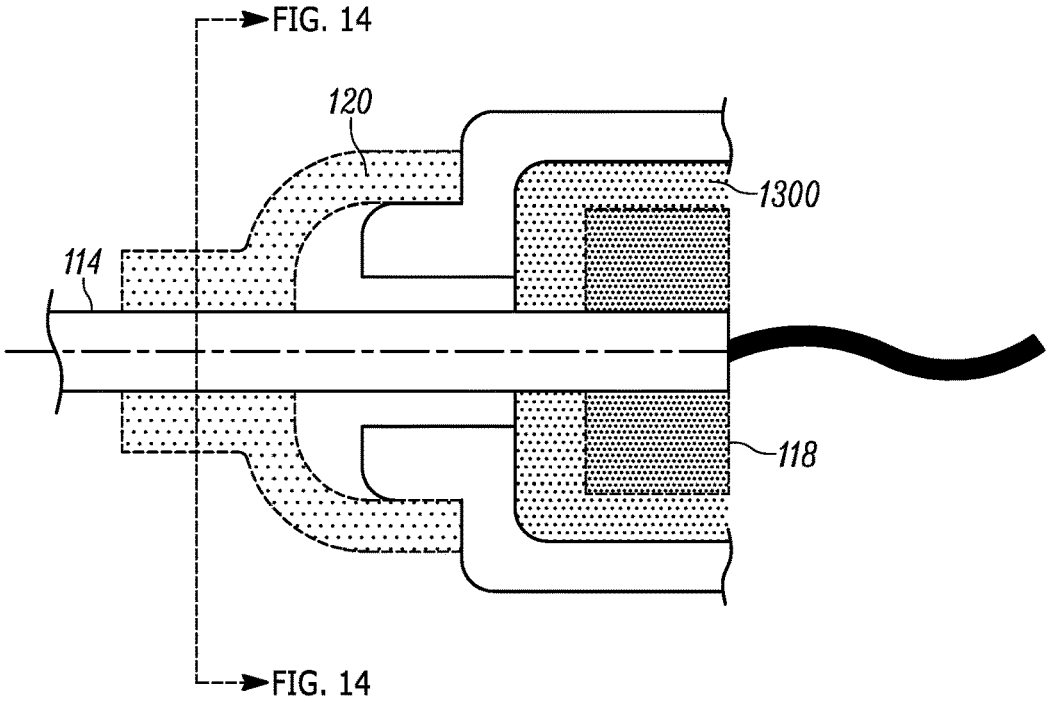
FIG. 13 is a cross-sectional view of a portion of a hearing device with a strain relief structure for a conduit.
Figure 14:
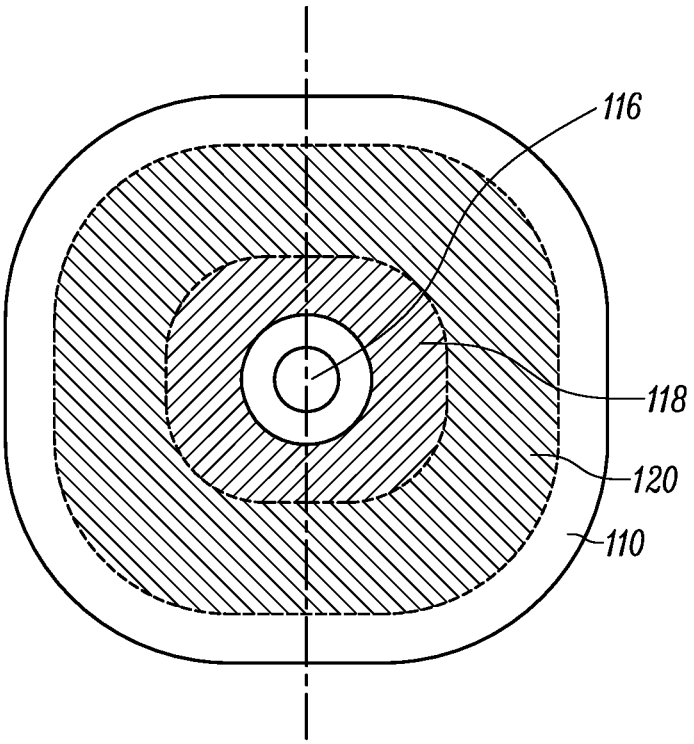
FIG. 14 is a cross-sectional view taken along lines a-a of FIG. 9.
Figure 15:
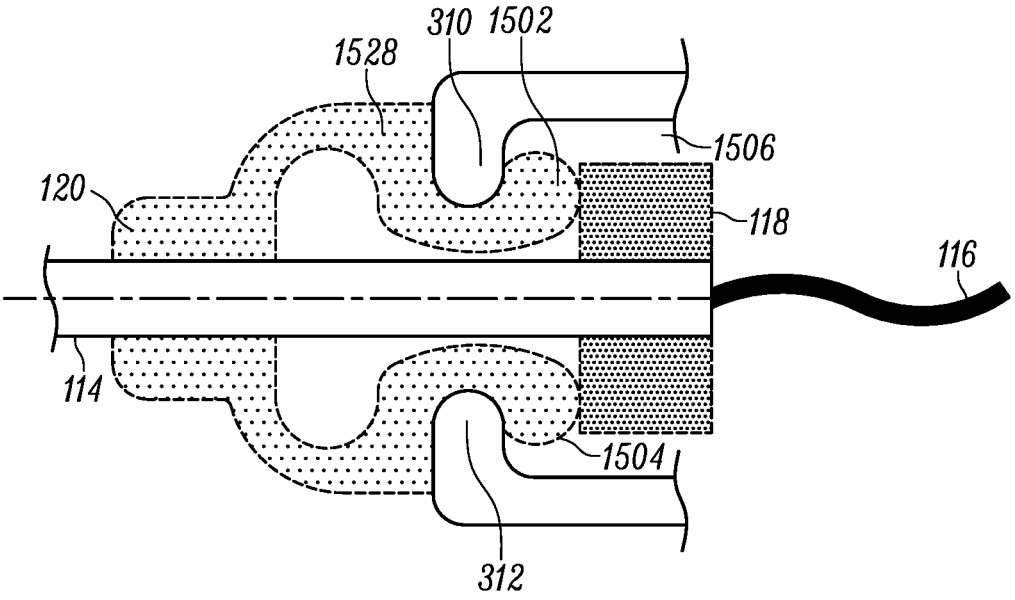
FIG. 15 is a cross-sectional view of a portion of a hearing device with a strain relief structure for a conduit disclosure.

Referring to FIGS. 13-15, the bushing 120 is shown in FIG. 13 to be an external bushing sleeve that is bounded around the conduit and the housing. An internal bushing 1300 may be optional. As illustrated in FIG. 15, the bushing is an external bushing sleeve that is retained by the retention flange and has a portion 1500 that is external to the retention space and a portion 1502 that is internal to the retention space. The bushing is adapted to contact the flange portions 310 and 312. In this example, the ferrule is not encompassed by the bushing. The bushing 120 has a portion 1504 that contacts the ferrule 118 within the retention space. Also shown in this example, the retention space is not filled by the bushing 120. Instead, the retention flange provides spacing 1506 between the retention flange and the ferrule. Alternatively, the ferrule may be sized to make contact with the inside surface of the retention flange.

Strain relief construction between the bushing and/or ferrule and/or housing can take many forms. For example, in some embodiments above the bushing is bonded to both the housing and ferrule. In some embodiments the bushing is bonded to the ferrule but not the housing. In some embodiments the bushing is bonded to the housing but not the ferrule. In some embodiments the bushing is unconstrained.

As illustrated and described above, a strain relief structure isolates the conduit from potentially damaging forces associated with handling of the hearing device by a user.

While the present disclosure and what is presently considered to be the best mode thereof has been described in a manner that establishes possession by the inventors and that enables those of ordinary skill in the art to make and use the same, it will be understood and appreciated that in light of the description and drawings there are many equivalents to the exemplary embodiments disclosed herein and that myriad modifications and variations may be made thereto without departing from the scope and spirit of the disclosure, which is to be limited not by the exemplary embodiments but by the appended claimed subject matter and its equivalents.

The invention claimed is:

1. A hearing device comprising: a housing having a sound opening disposed in a portion configured to contact a user's ear;

a sound-producing electro-acoustic transducer disposed in the housing, the transducer configured to generate an acoustic signal in response to an electrical excitation signal applied thereto, wherein the acoustic signal generated by the transducer emanates into the user's ear via the sound opening;

a retention flange coupled to the housing, the retention flange defining a retention space;

a conduit disposed about an electrical wire electrically coupled to the transducer;

a ferrule disposed about an end portion of the conduit, and the ferrule fixed along an axial dimension of the conduit;

a bushing having a portion disposed at least partially about at least a portion of the ferrule, the bushing formed of a soft material relative to a hardness of a material of the ferrule, at least the portion of the bushing disposed in the retention space and captured by the retention flange, wherein at least a portion of the bushing is located between the retention flange and at least the portion of the ferrule, and wherein the conduit is fixed relative to the housing.

2. The hearing device of claim 1, the ferrule includes a first flange portion and a second flange portion separated by a recess, the bushing is at least partially disposed in the recess of the ferrule, wherein the bushing is located between the retention flange and the first and second flange portions of the ferrule, and wherein the retention flange includes a flange portion disposed between the first and second flange portions of the ferrule when the portion of the bushing is disposed in the retention space.

3. The hearing device of claim 2, the end portion of the conduit about which the ferrule is disposed is located at least partially in the retention space, wherein an axial dimension of the ferrule is aligned with an axial dimension of the conduit.

4. The hearing device of claim 2, the bushing comprises a first annular member disposed about the ferrule in the recess and a second annular member disposed about the ferrule in the recess, the first annular member disposed between the first flange portion of the ferrule and the flange portion of the retention flange and the second annular member disposed between the second flange portion of the ferrule and the flange portion of the retention flange.

5. The hearing device of claim 4, the end portion of the conduit about which the ferrule is disposed is located at least partially in the retention space, wherein an axial dimension of the ferrule is aligned with an axial dimension of the conduit.

6. The hearing device of claim 4, the flange portion of the retention flange includes a generally convex surface, wherein the first annular member is disposed between the first flange portion of ferrule and a first surface portion of the retention flange and the second annular member is disposed between the second flange portion of the ferrule and a second surface portion of the retention flange.

7. The hearing device of claim 2, the end portion of the conduit about which the ferrule is disposed is not disposed in the retention space.

8. The hearing device of claim 2, wherein the conduit is rotationally fixed in the retention space of the hearing device.

9. The hearing device of claim 1, the retention flange includes a first flange portion and a second flange portion separated by a recess, the bushing is disposed at least partially in the recess of the retention member, wherein the bushing is located between the ferrule and the first and second flange portions of the retention flange, and wherein the ferrule is captured between the first and second flange portions of the retention flange when the portion of the bushing is disposed in the retention space.

10. The hearing device of claim 9, the end portion of the conduit about which the ferrule is disposed is located at least partially in the retention space, wherein an axial dimension of the ferrule is aligned with an axial dimension of the conduit.

11. The hearing device of claim 9, the bushing comprises a first annular member seated in a first recess of the ferrule and a second annular member seated in a second recess of the ferrule, the first recess spaced apart from the second recess, the first annular member disposed between the first flange portion of the retention flange and the ferrule and the second annular member disposed between the second flange portion of the retention flange and the ferrule.

12. The hearing device of claim 11, the end portion of the conduit about which the ferrule is disposed is located at least partially in the retention space, wherein an axial dimension of the ferrule is aligned with an axial dimension of the conduit.

13. The hearing device of claim 1 further comprising anti-rotation structure that prevents rotation of the conduit relative to the housing.

14. The hearing device of claim 1, the ferrule has a non-circular shape when the ferrule is viewed along the axial dimension of the conduit, the ferrule rotationally fixed to the conduit, wherein the non-circular shape prevents rotation of the ferrule relative to the housing.

15. The hearing device of claim 1, the ferrule rotationally fixed to the conduit, the retention flange and the ferrule having complementary shapes that limit rotation of the conduit relative to housing.

16. The hearing device of claim 1 further comprising an external bushing sleeve bonded to the conduit and to a portion of the housing defining the retention space.

17. The hearing device of claim 1, wherein the portion configured to contact the user's ear is an ear tip configured for insertion at least partially into the user's ear canal.

18. The hearing device of claim 15, the housing is a transducer housing including a cup and a cover, wherein the retention flange extends from the transducer housing.

19. The hearing device of claim 15, the transducer includes a transducer housing disposed within the housing, wherein the retention flange extends from the housing.

20. An electrical conduit strain relief structure for a hearing device having a retention flange defining a retention space, the strain relief structure comprising:

a conduit connectable to the hearing device;

a ferrule disposed about an end portion of the conduit, the ferrule fixed rotationally relative to the conduit, and the ferrule fixed along an axial dimension of the conduit;

a bushing having a portion disposed at least partially about at least a portion of the ferrule, the bushing formed of a soft material relative to a hardness of a material of the ferrule, at least the portion of the bushing, disposed about at least the portion of the ferrule, disposable and retainable in the retention space, wherein, when the bushing is disposed in the retention space, at least a portion of the bushing is located between the retention flange and at least the portion of the ferrule and the conduit is fixed relative to the hearing device.

* * * * *